US009034119B2

(12) United States Patent
Nakagawa et al.

(10) Patent No.: US 9,034,119 B2
(45) Date of Patent: May 19, 2015

(54) STEEL SHEET FOR CANS WITH EXCELLENT SURFACE PROPERTIES AFTER DRAWING AND IRONING AND METHOD FOR PRODUCING THE SAME

(75) Inventors: Yusuke Nakagawa, Fukuyama (JP); Masaki Tada, Fukuyama (JP); Katsumi Kojima, Fukuyama (JP); Hiroki Iwasa, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 633 days.

(21) Appl. No.: 13/259,589

(22) PCT Filed: Mar. 25, 2010

(86) PCT No.: PCT/JP2010/055978

§ 371 (c)(1), (2), (4) Date: Sep. 23, 2011

(87) PCT Pub. No.: WO2010/110485

PCT Pub. Date: Sep. 30, 2010

(65) Prior Publication Data

US 2012/0018055 A1 Jan. 26, 2012

(30) Foreign Application Priority Data

Mar. 27, 2009 (JP) ..... 2009-077920

(51) Int. Cl.

| | |
|---|---|
| ***C21D 8/04*** | (2006.01) |
| ***C22C 38/12*** | (2006.01) |
| ***C22C 38/04*** | (2006.01) |
| ***C21D 9/48*** | (2006.01) |
| ***C22C 38/00*** | (2006.01) |
| ***C22C 38/02*** | (2006.01) |
| ***C22C 38/06*** | (2006.01) |

(52) U.S. Cl.

CPC ..... *C22C 38/04* (2013.01); *C21D 8/0442* (2013.01); *C21D 8/0473* (2013.01); *C21D 9/48* (2013.01); *C21D 2211/004* (2013.01); *C21D 2211/005* (2013.01); *C22C 38/001* (2013.01); *C22C 38/004* (2013.01); *C22C 38/02* (2013.01); *C22C 38/06* (2013.01); *C22C 38/12* (2013.01)

(58) Field of Classification Search

CPC ..... C22C 38/001; C22C 38/02; C22C 38/04; C22C 38/06; C22C 38/002; C22C 38/004; C22C 38/12; C21D 8/0263; C21D 9/46; C21D 8/00; C21D 8/0442; C21D 8/0473; C21D 9/48; C21D 2211/004; C21D 2211/005

USPC ..... 148/328, 505, 330, 603, 650, 651

See application file for complete search history.

(56) References Cited

U.S. PATENT DOCUMENTS 6,743,306 B2 * 6/2004 Nakajima et al. ..... 148/328

FOREIGN PATENT DOCUMENTS

| | | | | | |
|---|---|---|---|---|---|
| JP | 7034194 | A | | 2/1995 | |
| JP | 08155565 | A | | 6/1996 | |
| JP | 8176735 | A | | 7/1996 | |
| JP | 8325670 | A | | 12/1996 | |
| JP | 09003547 | A | | 1/1997 | |
| JP | 11-209845 | | * | 8/1999 | ..... C22C 34/00 |
| JP | 11209845 | A | | 8/1999 | |
| JP | 2000239789 | A | | 9/2000 | |
| JP | 2000303145 | A | | 10/2000 | |
| JP | 2001131681 | A | | 5/2001 | |
| JP | 2002012943 | A | | 1/2002 | |
| JP | 2005187939 | A | | 7/2005 | |
| JP | 2005200747 | A | | 7/2005 | |
| JP | 2005336610 | A | | 12/2005 | |
| JP | 2006045590 | A | | 2/2006 | |
| JP | 2008214658 | A | | 9/2008 | |

OTHER PUBLICATIONS

International Application Serial No. PCT/JP2010/055978, International Search Report mailed Jun. 22, 2010, 2 pgs.

* cited by examiner

*Primary Examiner* — Jessee Roe
*Assistant Examiner* — Michael Aboagye
(74) *Attorney, Agent, or Firm* — RatnerPrestia

(57) ABSTRACT

A component composition contains, by % by mass, 0.0016 to 0.01% of C, 0.05 to 0.60% of Mn, and 0.020 to 0.080% of Nb so that the C and Nb contents satisfy the expression, $0.4 \leq (Nb/C) \times (12/93) \leq 2.5$. In addition, the amount of Nb-based precipitates is 20 to 500 ppm by mass, the average grain diameter of the Nb-based precipitates is 10 to 100 nm, and the average crystal grain diameter of ferrite is 6 to 10 μm. Nb is added to ultra-low-carbon steel used as a base, and the amount and grain diameter of the Nb-based precipitates are controlled to optimize the pinning effect. Grain refinement of ferrite is achieved by specifying the Mn amount, thereby achieving softening and excellent resistance to surface roughness of steel.

4 Claims, No Drawings

STEEL SHEET FOR CANS WITH EXCELLENT SURFACE PROPERTIES AFTER DRAWING AND IRONING AND METHOD FOR PRODUCING THE SAME

CROSS-REFERENCE TO RELATED APPLICATIONS

This application is the U.S. National Phase application of PCT International Application No. PCT/JP2010/055978, filed Mar. 25, 2010, and claims priority to Japanese Patent Application No. 2009-077920, filed Mar. 27, 2009, the disclosures of which PCT and priority applications are incorporated herein by reference in their entirely for all purposes.

FIELD OF THE INVENTION

The present invention relates to a steel sheet (steel sheet for cans) suitable for can containers used for food and drinks, and a method for producing the steel sheet. In particular, the present invention relates to a steel sheet for cans with excellent surface properties after drawing and ironing which has excellent deep drawability and which causes little surface roughness and no film exfoliation after working, and also relates to a method for producing the steel sheet.

BACKGROUND OF THE INVENTION

In general, a method of protecting can contents by providing organic coatings on the inner surfaces of cans after can making has been used for general two-piece cans, like DRD (Drawing and Redrawing) cans and DI (Drawing and Wall Ironing) cans. On the other hand, laminated steel sheets including metal sheets previously coated with organic resin films before forming have recently attracted attention in view of global environment conservation. Since the laminated steel sheets do not require lubricating oil, which is generally required for deep drawing and ironing, because the films have lubricity, a step of washing off the lubricating oil is omitted, thereby causing the advantage of no discharge of cleaning waste water. Further, the need for a coating step and a baking step for the inner surfaces of cans in order to protect the contents and surfaces of steel sheets is eliminated, and thus there occurs the advantage of no occurrence of carbon dioxide which is discharged as green house gas in the baking step.

As described above, the can making method using the laminated steel sheets can greatly contribute to global environment conservation and the demand therefore is considered to be expanded in future. However, this method causes the new problem of degrading corrosion resistance due to exfoliation of coating films from the steel sheets, which are used as base materials, after can making.

Therefore, factors for the steel sheets used as base materials include high formability enough to resist a high rate of working such as deep drawing and ironing and the surface properties enough to prevent surface roughness in order to keep the good adhesion to the films after can making.

In addition, a coolant for cooling dies which are heated by working heat during can making of the steel sheets and lubricating oil are not used, and thus the working head is likely to adversely affect the productivity of can making. As a countermeasure against this, it is also a factor that the steel sheets are soft and cause little working heat in addition to the resistance to surface roughening.

In view of the above, Patent Literature 1 proposes a method for producing a steel sheet in which Nb is added to ultra-low-carbon steel containing about 0.001 to 0.005% by mass of C, and the average crystal gain diameter is adjusted to 6 μm or less by shortening the time required from the end of finish hot-rolling to the start of strip quenching, appropriately determining a hot-rolling coiling temperature, and the effect of addition of Mn, thereby preventing surface roughness. The method of Patent Literature 1 realizes refinement of crystal grains by controlling NbC precipitation during hot rolling while maintaining high workability by chemical component design using the ultra-low-carbon steel as a base. However, 0.4 to 1.0% by mass of Mn which is a typical solid-solution hardening element is added for achieving refinement of crystal grains, and thus the working heat of a steel sheet during can making cannot be sufficiently suppressed.

Patent Literature 2 proposes a method for producing a steel sheet using steel containing 0.0050% by mass or less of C, 0.0200% or less of N, and one or two selected from Nb and Ti, in which grain refinement of a hot-rolled sheet is achieved by controlling the sheet thickness after hot rolling to less than 1.8 mm and increasing the cooling rate after finish hot rolling, and surface roughness is suppressed by a high reduction rate of cold rolling and continuous annealing for a short time, so that performances such as a balance between excellent strength and ductility, a high average r value, and good planar anisotropy are satisfied. The method of Patent Literature 2 is capable of producing a steel sheet having excellent quality, but hot ductility may be decreased by positively adding N, and water cooling equipment is required to be installed near the outlet side of a rolling machine because water cooling is started within a short time after the end of finish rolling after hot rolling. This is accompanied by the need for removing a thermometer and a sheet thickness meter which are generally installed. Therefore, there occurs the problem of modification of equipment and an operational problem, such as the need for a higher degree of rolling control capability.

Patent Literature 3 proposes a technique for achieving grain refinement of ultra-low-carbon steel containing Nb and Ti and preventing film hair during DI can working. In addition, with 0.007 to 0.01% by mass of C, softening is achieved by overaging during annealing. However, Ti has the possibility of impairing plating performance by a linear defect such as a Ti mark according to the amount of Ti added, and Ti is preferably added in as a small mount as possible from the viewpoint of attaching importance to corrosion resistance and appearance.

Patent Literature 4 proposes a can making method using as a raw material a steel sheet containing 0.0005 to 0.0050% by mass of C, 0.20% by mass or less of Si, 0.05 to 1.00% by mass of Mn, 0.005 to 0.100% by mass of Al, 0.003 to 0.020% by mass of Nb, 0.100% by mass or less of P, 0.010% by mass or less of S, and 0.0050% by mass or less of N, the steel sheet having excellent formability and being controlled to an average r value of 1.5 or more and an absolute $\Delta r$ value of 0.30 or less, in which a drawing ratio during cupping for DI can making is controlled to 1.80 or more so that work hardening is performed by applying elongation strain to a bottom portion, thereby increasing the compression strength of the bottom portion. However, this method requires a change in a drawing/ironing schedule and thus possibly influences the can making rate.

Patent Literature 5 proposes a steel sheet having excellent burr resistance and a method for producing the same, in which steel containing 0.004 to 0.01% by mass of C, 0.05% by mass or less of P, 0.02% by mass or less of S, 0.01 to 0.1% by mass of sol. Al, 0.004% by mass or less of N, 0.03% by mass or less of Ti, and Nb added to satisfy $1 \leq (93/12) \times (Nb/C) \leq 2.5$ is subjected to finish final two passes of hot rolling under high pressure to finely and uniformly disperse Nb-based precipitates. It is essential to perform the finish final two passes under high pressure, thereby causing the problem of increasing an operating load of hot-rolling.

Patent Literature 6 proposes a thin steel sheet for pressing, in which one of Nb-based and Ti-based precipitates is precipitated in a ferrite phase so that the ferrite grain size is 10 or more and a low-density precipitate region is provided near a ferrite grain boundary. The low-density precipitate region extends a degree of forming allowance of pressing.

Patent Literature 7 proposes a steel sheet with excellent press formability, characterized in that the steel sheet is composed of steel containing 0.0040 to 0.015% by mass of C, 0.05% by mass or less of Si, 1.5 to 3.0% by mass of Mn, 0.01 to 0.1% by mass of P, 0.02% by mass or less of S, 0.01 to 0.1% by mass of sol. Al, 0.004% by mass or less of N, and 0.04 to 0.25% by mass of Nb and satisfying the expression $1.5 \leq Nb/(7.75 \times C)$ defined by a C amount and a Nb amount being 1.5-2.5, and has a region near a ferrite grain boundary at a lower Nb-based precipitate density than inside a grain.

Patent Literature 8 proposes a high-strength cold-rolled steel sheet characterized in that the steel sheet includes ferrite grains having an average grain diameter of 10 μm or less, the average number of Nb(C,N) grains having a diameter of 50 nm or more per unit area is $7.0 \times 10^{-2}/\mu m$, and a region with a width of 0.2 to 2.4 μm is formed along the grain boundary of a ferrite grain, the average area density of NbC in the region being 60% or less of the average area density of NbC precipitated in a central portion of the ferrite grain. Patent Literature 8 provides a high-strength cold-rolled steel sheet excellent in resistance to planar strain and in punch stretchability by decreasing YS to 270 MPa.

However, in Patent Literatures 6 to 8, a region where NbC is coarsely distributed is formed near a ferrite grain boundary by controlling NbC precipitation, thereby decreasing YS and improving formability. However, lower YS is undesirable for two-piece cans in view of maintaining the compression strength of bottom portions which have a relatively low working ratio.

Patent Literature 9 proposes a cold-rolled steel sheet with excellent dent resistance, characterized in that the steel sheet contains 0.0040 to 0.02% by mass of C, 1.5% by mass or less of Si, 0.5 to 3.0% by mass of Mn, 0.01 to 0.1% by mass of P, 0.02% by mass or less of S, 0.15 to 1.5% by mass of sol. Al, 0.001 to 0.005% by mass of N, and 0.04 to 0.2% by mass of Nb and has C and Nb contents satisfying $1.0 \leq (12/93) \times (Nb/C) \leq 2.2$ and Al and N contents satisfying $26 \leq (14/27) \times (Al/N) \leq 400$, and the average grain diameters of Nb carbide and Al nitride are 10 to 200 nm and 50 to 500 nm, respectively.

PATENT LITERATURE

PTL 1: Japanese Unexamined Patent Application Publication No. 11-209845

PTL 2: Japanese Unexamined Patent Application Publication No. 9-3547

PTL 3: Japanese Unexamined Patent Application Publication No. 2006-45590

PTL 4: Japanese Unexamined Patent Application Publication No. 8-155565

PTL 5: Japanese Unexamined Patent Application Publication No. 2000-239789

PTL 6: Japanese Unexamined Patent Application Publication No. 2002-12943

PTL 7: Japanese Unexamined Patent Application Publication No. 2001-131681

PTL 8: Japanese Unexamined Patent Application Publication No. 2005-187939

PTL 9: Japanese Unexamined Patent Application Publication No. 2005-200747

SUMMARY OF THE INVENTION

As described above, it is very difficult for related art to refine crystal grains and obtain a steel sheet for cans which is soft and exhibits small working heat and high formability. In addition, even when a steel sheet for cans which is soft and exhibits small working heat and high formability can be obtained, the problems of increasing the production cost and causing difficulty with equipment and operations newly occur.

The present invention has been achieved in consideration of the above-described situation and provides a steel sheet for cans with excellent surface properties after drawing and ironing, which causes little surface roughness and no film exfoliation after working, and also provides a method for producing the steel sheet.

The present invention according to exemplary embodiments is as follows.

[1] A steel sheet for cans with excellent surface properties after drawing and ironing, the steel sheet containing, by % by mass, 0.0016 to 0.01% of C, 0.05% or less of Si, 0.05 to 0.60% of Mn, 0.02% or less of P, 0.02% or less of S, 0.01 to 0.10% of Al, 0.0015 to 0.0050% of N, and 0.020 to 0.080% of Nb, the C and Nb contents satisfying expression (1) below, the balance being composed of Fe and inevitable impurities, and the steel sheet being characterized in that the amount of Nb-based precipitates is 20 to 500 ppm by mass, the average grain diameter of Nb-based precipitates is 10 to 100 nm, and the average crystal grain diameter of ferrite is 6 to 10 μm:

$$0.4 \leq (Nb/C) \times (12/93) \leq 2.5 \quad (1)$$

wherein Nb and C each indicate a content (% by mass).

[2] The steel sheet for cans with excellent surface properties after drawing and ironing described in [1], the steel sheet being characterized by being a laminated steel sheet including a chromium metal plating film formed on a surface of a steel sheet, a chromium oxide layer formed on the plating film, and an organic resin coating layer formed on the chromium oxide layer.

[3] A method for producing a steel sheet for cans with excellent surface properties after drawing and ironing, the method including hot-rolling steel which contains, by % by mass, 0.0016 to 0.01% of C, 0.05% or less of Si, 0.05 to 0.60% of Mn, 0.02% or less of P, 0.02% or less of S, 0.01 to 0.10% of Al, 0.0015 to 0.0050% of N, and 0.020 to 0.080% of Nb, the C and Nb contents satisfying expression (1) below and the balance being composed of Fe and inevitable impurities; pickling the steel; cold-rolling the steel at a rolling reduction rate of 90% or more; and then continuously annealing the steel at a temperature of a recrystallization temperature or more and 780° C. or less, and the method being characterized in that the amount of Nb-based precipitates is 20 to 500 ppm by mass, the average grain diameter of the Nb-based precipitates is 10 to 100 nm, and the average crystal grain diameter of ferrite is 6 to 10 μm:

$$0.4 \leq (Nb/C) \times (12/93) \leq 2.5 \quad (1)$$

wherein Nb and C each indicate a content (% by mass).

According to aspects of the present invention, it is possible to produce a steel sheet for cans with excellent surface properties which causes little surface roughness and no film exfoliation after drawing and ironing.

For example, it is possible to provide a laminated steel sheet for DI cans with excellent surface properties after working, in which surface roughness of a steel sheet after ironing is suppressed, and a base steel sheet is prevented from being exposed due to deterioration of adhesion between a film and the steel sheet and film fracture caused by stress concentration on a roughened surface of the steel sheet.

DETAILED DESCRIPTION OF THE INVENTION

The inventors conducted keen investigation for resolving the above-described problems. As a result, the following finding was obtained.

In order to achieve high workability enough to resist severe deep-drawing and ironing, chemical components were designed using ultra-low-carbon-steel as a base. Further, Mn which is an element for solid-solution hardening of steel was adjusted to a proper range in which no problem rises in production. In addition, it was found that when hot-rolling conditions, cold-rolling conditions, and continuous annealing conditions for the steel are appropriately controlled so that the amount of Nb-based precipitates is 20 to 500 ppm by mass, the average grain diameter of the Nb-based precipitates is 10 to 100 nm, and the average crystal grain diameter of ferrite is 6 to 10 μm, it is possible to produce a steel sheet for cans which is soft and does not produce such surface roughness that corrosion resistance is degraded, and which can secure compression strength after can making.

Specifically, ultra-low-carbon steel is used as a base, and the amount and grain diameter of Nb-based precipitates are controlled by adding Nb, thereby optimizing the pinning effect. In addition, the amount of Mn added is specified to 0.05% to 0.60% by mass so that the ferrite grains are refined, and steel softness and excellent resistance to surface roughness can be achieved. Further, with a steel sheet having such a composition component and structure, it is possible to secure compression strength of a bottom after DI forming and further thin a can body.

The present invention is described in detail below with reference to exemplary embodiments.

First, steel components are described. In the specification, "%" indicating steel components is "% by mass".

C: 0.0016 to 0.01% by Mass

C greatly influences formability and crystal grain refinement. With less than 0.0016% by mass of C, excellent formability can be achieved, but an average ferrite grain diameter of 10 μm or less cannot be easily achieved. On the other hand, with over 0.01% by mass of C, C is solid-dissolved in ferrite, thereby hardening a matrix and degrading formability. Therefore, the C content is in a range of 0.0016 to 0.01% by mass in order to satisfy both the formability and refinement of crystal grains.

Si: 0.05% by Mass or Less

When a large amount of Si is added, the problem of degrading the surface treatment properties and corrosion resistance of the steel sheet occur. Therefore, the Si content is 0.05% by mass or less, preferably 0.02% by mass or less.

Mn: 0.05 to 0.60% by Mass

In order to prevent a decrease in hot ductility due to impurity S contained in steel, it is preferred to add 0.05% by mass or more of Mn. Mn is an element which decreases the Ar3 transformation point and can further decrease the finish hot-rolling temperature. Therefore, recrystallized grain growth of γ-grains is suppressed during hot rolling, and α-grains after transformation can be refined. In addition, further grain refinement is achieved by adding Mn to Nb-added ultra-low-carbon steel, thereby securing compression strength after can making. Therefore, the lower limit of the Mn content is 0.05% by mass. On the other hand, in the ladle analytical values defined in JIS G 3303 and the ladle analytical values of American Society for Testing Materials (ASTM), the upper limit of Mn in black plates used for general food containers is defined to 0.6% by mass or less. Therefore, the upper limit of the Mn content is 0.6% by mass or less.

P: 0.02% by Mass or Less

When a large amount of P is added, steel is hardened, and corrosion resistance is decreased. In addition, excessive decrease in the P content is undesirable because the effect of P is saturated, and the production cost is increased. Therefore, the upper limit of the P content is 0.02% by mass.

S: 0.02% by Mass or Less

S bonds to Mn in steel to form MnS, and decreases hot-ductility of steel due to a large amount of precipitation. Therefore, the upper limit of the S content is 0.02% by mass.

Al: 0.01 to 0.10% by Mass

Al is an element added as a deoxidizer. In addition, Al has the effect of decreasing solid-dissolved N in steel by forming AlN with N. However, when the Al content is less than 0.01% by mass, the deoxidizing effect and the effect of decreasing the solid-dissolved N cannot be sufficiently obtained. On the other hand, when the Al content exceeds 0.10% by mass, these effects are saturated, and inclusions such as Al are undesirably increased. Therefore, the Al content is in the range of 0.01 to 0.10% by mass.

N: 0.0015 to 0.0050% by Mass

N forms a nitride and carbonitride by bonding to Al and Nb and impairs hot ductility, and thus the N content is preferably as low as possible. Also, N is an element for solid-solution hardening, and addition of a large amount leads to hardening of steel and a significant decrease in elongation, thereby worsening formability. However, it is difficult to stably control the N content to less than 0.0015% by mass, thereby increasing the production cost. Therefore, the N content is 0.0015 to 0.0050% by mass.

Nb: 0.02 to 0.08% by Mass

Nb is an element which forms NbC or Nb(C,N), has the effect of decreasing solid-dissolved C in steel, and is added for improving elongation and r-value. In addition, crystal grain refinement can be made by the pinning effect on grain boundaries due to carbonitride, which is formed by adding Nb, and by the drag effect on grain boundaries due to solid-dissolved Nb in steel. On the other hand, when the Nb content exceeds 0.08% by mass, the temperature for complete recrystallization is increased, and thus, in particular, steel sheets for cans, which are often thin materials, are difficult to industrially produce through a continuous annealing step. Therefore, the Nb content is 0.02 to 0.08% by mass.

Further, in the present invention, the C and Nb contents preferably satisfy the following expression (1):

$$0.4 \leq (Nb/C) \times (12/93) \leq 2.5 \quad (1)$$

wherein Nb and C each indicate a content (% by mass).

When $(Nb/C) \times (12/93)$ is less than 0.4, the refinement effect due to NbC is not sufficient, and ferrite grains are coarsened. On the other hand, when $(Nb/C) \times (12/93)$ exceeds 2.5, recrystallization is excessively delayed by the solute drag effect of solid-dissolved Nb, causing difficulty in production, and the pinning effect is decreased by coarsening of Nb(C,N), thereby coarsening ferrite grains.

The balance is composed of Fe and inevitable impurities.

Next, the ferrite grain diameter and the Nb-based precipitates are described.

Regarding Ferrite Grain Diameter

The extent of surface roughness of the steel sheet after drawing and ironing is proportional to the diameter of the ferrite grains. In DI forming of a laminated steel sheet, corrosion resistance is degraded by exposure of the base steel sheet due to film exfoliation from the steel sheet which is caused by surface roughness of the steel sheet and due to film fracture which is caused by stress concentration on the film. Therefore, the ferrite average crystal grain diameter in a section of the steel sheet in the rolling direction, the steel sheet being used as the base of the laminated steel sheet for DI cans, is 10 μm or less, preferably 9 μm or less. On the other hand, when the crystal gains are excessively fine, the strength of the steel sheet is significantly increased by grain refinement strengthening. Therefore, the lower limit of the average grain diameter of ferrite in a section in the rolling direction is 6 μl or more.

The average grain diameter of ferrite is measured by an intercept method according to Steels—Micrographic determination of the apparent grain size of JIS G 0551 using a 400× photograph which is obtained by etching a ferrite structure of a section in the rolling direction with a 3% nital solution to reveal grain boundaries and photographing the structure with an optical microscope. The present invention relates to ferrite single-phase steel to which the elements described in the claims are added and which contains precipitates such as $Fe_3C$, Nb(C,N), MnS, and AlN. The precipitates have the maximum grain diameter of about 2 to 3 μm for $Fe_3C$ and are present in an amount of less than 1% of the observation surface of the structure, thereby causing no influence on the method for measuring the ferrite average grain diameter.

Regarding Nb-Based Precipitate

The present invention, according to exemplary embodiments, utilizes crystal grain refinement due to the pinning effect of the precipitates on grain boundaries. It is generally known that the pinning effect of precipitates is more strongly exhibited as the grain diameter of the precipitates decreases and the amount of precipitation increases. However, when the pinning effect is excessive, the steel sheet is hardened by precipitation strengthening and grain refinement strengthening due to excessive crystal grain refinement. Therefore, in the present invention, in order to realize a material with such softness that workability is not impaired, the Nb amount and C amount are preferably controlled so as to satisfy $0.4 \leq (Nb/C) \times (12/93) \leq 2.5$, and the hot-rolling conditions are optimized. In the present invention, from the viewpoint of a balance between good workability and the resistance to surface roughness due to crystal grain refinement, the amount of the Nb-based precipitates is preferably 20 to 500 ppm by weight, and the average grain diameter of the Nb-based precipitates is preferably 10 to 100 nm.

In the present invention, the Nb-based precipitates preferably include NbC, NbN, and Nb(C,N). The Nb-based precipitates can be confirmed by constant-current electrolysis (20 $mA/cm^2$) of a sample in a 10% acetylacetone-1% tetramethyl ammonium chloride-methanol solution and recovering the extraction residue with a 200-nm filter, followed by ICP emission spectrochemical analysis.

Next, a method for producing a steel sheet for cans which exhibits excellent surface properties after drawing and ironing according to exemplary embodiments of the present invention is described.

Steel having the above-described composition is hot-rolled, pickled, cold-rolled with a rolling reduction rate of 90% or more, and then continuously annealed at a temperature of the recrystallization temperature or more and 780° C. or less.

Slab Reheating Temperature (Preferred Condition): 1050 to 1300° C.

The slab reheating temperature before hot rolling is not particularly specified, but an excessively high heating temperature causes the problem of producing surface defects of the product and increasing the energy cost. On the other hand, an excessively low temperature causes difficulty in securing the final finish rolling temperature. Therefore, the slab reheating temperature is preferably in the range of 1050 to 1300° C.

Hot-rolling conditions (preferred conditions): final finish rolling temperature 860 to 950° C., coiling temperature 500 to 640° C.

From the viewpoint of crystal grain refinement and uniformity of the precipitate distribution of a hot-rolled steel sheet, the preferred hot-rolling conditions include a final finish rolling temperature in the range of 860° C. to 950° C. and a coiling temperature in the range of 500° C. to 640° C.

When the final finish rolling temperature is higher than 950° C., γ-grain growth after rolling more significantly takes place, and accordingly α-grains after transformation are coarsened by coarse γ-grains. In addition, when the final finish rolling temperature is lower than 860° C., rolling is performed at the Ar3 transformation point or lower, thereby coarsening the α-grains.

When the coiling temperature is higher than 640° C., the amount of the Nb-based precipitates is increased, but the precipitates are coarsened, thereby decreasing the pinning effect of the precipitates and coarsening the α-grains. In addition, within a temperature range lower than 500° C., the amount of the Nb-based precipitates is decreased, and thus the α-phase cannot be refined by the pinning effect.

More preferably, the final finish rolling temperature is in the range of 860 to 930° C., and the coiling temperature is in the range of 500 to 600° C.

The pickling conditions are not particularly specified as long as surface-layer scales can be removed. Pickling can be performed by a usual method.

Cold-Rolling Reduction Rate: 90% or More

The reduction rate of cold rolling is ideally 90% or more in order to achieve the average ferrite crystal grain diameter preferred in the present invention. When the reduction rate is less than 90%, crystal grains are coarsened to degrade the material quality. Further, when the reduction rate is 90% or more, a large amount of strain energy can be accumulated in the steel sheet, and Nb remaining solid-dissolved without being precipitated during hot-rolling is employed as precipitation sites, so that fine Nb-based precipitates are produced in many sites in the next step of annealing, thereby realizing crystal grain refinement by the pinning effect.

Annealing Temperature: Recrystallization Temperature to 780° C.

The annealing method is preferably a continuous annealing method from the viewpoint of quality uniformity and high productivity. It is preferred that the annealing temperature of continuous annealing is the recrystallization temperature or more. However, at an excessively high annealing temperature, crystal grains are coarsened, thereby increasing surface roughness after working and increasing the risk of failure in a furnace or buckling of a thin material such as a steel sheet for cans. Therefore, the upper limit of the annealing temperature is 780° C.

Temper Rolling Reduction Rate (Preferred Condition): 0.5 to 5%

The reduction rate of temper rolling is appropriately determined by a temper grade of the steel sheet, but rolling is preferably performed at a reduction rate of 0.5% or more in order to suppress the occurrence of stretcher strain. On the other hand, rolling at a reduction rate exceeding 5% decreases workability and elongation due to hardening of the steel sheet and further decreases the r value and increases the planar anisotropy of the r value. Therefore, the upper limit is 5%.

Under the above-described conditions, the steel sheet for cans having excellent surface properties after drawing and ironing can be produced.

At DI working of a laminated steel sheet, as described above, a coolant is not used. Therefore, from the viewpoint of productivity, it is preferred to suppress as much as possible the working heat at the DI working. Based on the results of determination of strength of the steel sheet by a Rockwell hardness test method (HR30T) and calculation of the amount of heat generated at DI working, in the present invention, the temper grade is preferably T3CA or less (57 points or less in terms of HR30T) in order to achieve, for DI cans using the laminated steel sheet, productivity equivalent to the can making rate of existing tin DI cans formed using a coolant.

The steel sheet for cans can be formed as a laminated steel sheet by surface-treating the steel sheet produced as described above, forming a chromium metal plating layer and a chromium oxide layer on a surface of the steel sheet to form a tin-free steel sheet, and then laminating an organic resin coating layer such as a polyester film or a PET film on the tin-free steel sheet.

EXAMPLES

Steel having each of the compositions shown in Table 1 was melted to form a steel slab, and the resultant steel slab was subjected to hot-rolling, cold-rolling, simulation of continuous annealing by a direct electrification heating method, and temper rolling under the conditions shown in Table 2 to produce a steel sheet for cans, having a final thickness of each of 0.22 mm, 0.24 mm, and 0.31 mm. Then, a test piece of the resultant steel sheet for cans was subjected to the following tests.

TABLE 1

| | Chemical component (% by mass) | | | | | | | | (Nb/C) × | |
|---|---|---|---|---|---|---|---|---|---|---|
| Steel symbol | C | Si | Mn | P | S | Al | N | Nb | (12/93) | Remarks |
| A | 0.0019 | 0.01 | 0.13 | 0.010 | 0.016 | 0.054 | 0.0029 | 0.018 | 1.2 | Comparative Example |
| B | 0.0020 | 0.01 | 0.13 | 0.011 | 0.017 | 0.053 | 0.0027 | 0.039 | 2.5 | Example |
| C | 0.0016 | 0.01 | 0.14 | 0.010 | 0.017 | 0.048 | 0.0029 | 0.097 | 7.8 | Comparative Example |
| D | 0.0064 | 0.01 | 0.13 | 0.016 | 0.013 | 0.061 | 0.0022 | 0.020 | 0.4 | Example |
| E | 0.0065 | 0.01 | 0.13 | 0.017 | 0.014 | 0.051 | 0.0023 | 0.057 | 1.1 | Example |
| F | 0.0062 | 0.01 | 0.13 | 0.017 | 0.013 | 0.053 | 0.0021 | 0.097 | 2.0 | Comparative Example |
| G | 0.0059 | 0.01 | 0.99 | 0.048 | 0.010 | 0.048 | 0.0029 | 0.096 | 2.1 | Comparative Example |
| H | 0.0066 | 0.01 | 0.60 | 0.008 | 0.017 | 0.050 | 0.0023 | 0.020 | 0.4 | Example |
| I | 0.0063 | 0.01 | 0.60 | 0.008 | 0.016 | 0.050 | 0.0029 | 0.051 | 1.0 | Example |
| J | 0.0063 | 0.01 | 0.60 | 0.009 | 0.017 | 0.051 | 0.0025 | 0.102 | 2.1 | Comparative Example |

Measurement of Hardness

Rockwell 30T hardness (HR30T) was measured at a position specified by JIS G3315 according to the Rockwell hardness test method of JIS Z2245.

Measurement of Ferrite Average Crystal Grain Diameter

The ferrite crystal grain diameter was measured by an intercept method according to Steels—Micrographic determination of the apparent grain size of JIS G 0551 using a 400× photograph obtained by etching a section of the test piece in the rolling direction with a 3% nital solution to reveal grain boundaries, and photographing the section with an optical microscope.

Measurement of Rate of Unrecrystallized Structure

A section of the test piece in the rolling direction was etched to reveal a ferrite structure and photographed with an optical microscope at a 200× magnification. In the obtained photograph, an unrecrystallized structure portion and a recrystallized structure portion were discriminated by image processing, and an area ratio of unrecrystallized grains was calculated.

Quantitative Analysis of Nb-Based Precipitates

After a precipitate phase was extracted from each annealed sample by electrolysis in a 10% acetylacetone-1% tetramethyl ammonium chloride-methyl alcohol electrolytic solution, quantitative analysis of Nb-based precipitates was performed by ICP analysis.

Tem Observation of Average Grain Diameter of Nb-Based Precipitates of Annealed Sheet The average grain diameter of precipitates was determined by TEM observation of a sample formed by an extract replica method. A sample which was mirror-polished to a central layer of the annealed sheet was etched with a 2% nitric acid alcohol etchant, and a replica film was formed by carbon deposition. Further, the replica film was removed by electrolysis and then observed with TEM. The sample was observed with a total field of view of 1 $mm^2$ for a central layer of the annealed sheet at each level to determine an average area of the precipitates. The diameter of an equivalent circle of the average area was determined.

In the present invention, the amount and grain diameter of the Nb-based precipitates of the steel sheet after annealing can be controlled by optimizing a component balance between Nb and C amounts, the coiling temperature of hot-rolling, the cold-rolling reduction rate, and the annealing conditions. When the amount of the Nb-based precipitates of the steel sheet is 20 to 500 ppm by mass and the grain diameter of the Nb-based precipitates of the steel sheet is in the range of 10 to 100 nm, the pinning effect of the Nb-based precipitates is effective in refinement of the crystal grains.

Working Heat

In the present invention, in order that productivity equivalent to the can making rate of tin DI cans using an existing coolant is achieved with DI cans using a laminated steel sheet, the temper grade is preferably T3CA or less (57 points or less in terms of HR30T). Since the working heat depends on the strength of the steel sheet, less than 57 in terms of HR30T after annealing was evaluated as "small working heat" (⊙), 57 to less than 59 in terms of HR30T after annealing was evaluated as "slightly small working heat" (○) at the level of no problem in can making, and 59 or more in terms of HR30T after annealing was evaluated as "large working heat" (x).

Measurement of Compression Strength

The compression strength was measured using a buckling tester for DI cans. Air pressure was applied from the inside of a can, and when the pressure was rapidly decreased during buckling, the pressure was read and determined as the compression strength. At a pressing rate of 0.7 kgf/(cm$^2$·s), the pressure of 7.3 kgf/cm$^2$ or more was evaluated as "excellent (⊙)", the pressure of 7.2 to 6.8 kgf/cm$^2$ was evaluated as "good (○)", and the pressure of 6.7 kgf/cm$^2$ or less was evaluated as "poor (x)".

Surface Roughness

The surface roughness of a steel sheet was determined by measuring the surface roughness of a can body portion of a sample after DI can making and examining maximum height $R_{max}$. In an example, a steel sheet laminated with a PET film was used as a blank sheet of ϕ123 and formed into a can of 52.64 mm in diameter and 107.6 mm in height by drawing with a 1$^{st}$ and 2$^{nd}$ cupping drawing ratios of 1.74 and 1.35, respectively, and further three-stage ironing so that the maximum reduction in thickness of the body portion was 49% (equivalent strain 1.4). After can making, the laminated film of the sample was separated using a NaOH solution, and the surface roughness of the can body portion having the highest working rate was measured. It was found that when the maximum surface height $R_{max}$ of the steel sheet after can making is less than 7.4 μm, the film is not damaged by the steel sheet, and corrosion resistance is maintained. In the present invention, the maximum height $R_{max}$ of less than 7.4 μm was evaluated as little surface roughness (good), the maximum height $R_{max}$ of 7.4 μm to less than 9.5 μm was evaluated as slightly little surface roughness (fair), and the maximum height $R_{max}$ of 9.5 μm or more was evaluated as much surface roughness (poor). The object of evaluation in the present invention was in the range of unrecrystallized area ratios of 0.5 to 5%, and levels outside the range were nontarget for evaluation.

The results obtained as described above are shown in Table 2 together with the experimental conditions.

TABLE 2

| Experiment No. | Steel symbol | Slab reheating temperature (° C.) | Rough rolling start temperature (° C.) | Finish rolling temperature (° C.) | Coiling temperature (° C.) | Cold rolling reduction rate (%) | Annealing temperature (°C.) | Thickness of final finished sheet (mm) | HR30T | Average grain diameter of ferrite (μm) |
|---|---|---|---|---|---|---|---|---|---|---|
| 1 | A | 1250 | 1050 | 900 | 580 | 92.3 | 750 | 0.22 | 49.4 | 11.6 |
| 2 | A | 1250 | 1050 | 900 | 580 | 91.4 | 750 | 0.24 | 46.7 | 11.7 |
| 3 | A | 1250 | 1050 | 900 | 580 | 88.9 | 750 | 0.31 | 47.1 | 11.6 |
| 4 | B | 1250 | 1050 | 900 | 580 | 91.4 | 750 | 0.24 | 49.7 | 9.9 |
| 5 | C | 1250 | 1050 | 900 | 580 | 91.4 | 750 | 0.24 | 54.0 | Unrecrystallized |
| 6 | D | 1250 | 1050 | 900 | 580 | 91.4 | 750 | 0.24 | 51.9 | 8.1 |
| 7 | D | 1250 | 1050 | 920 | 580 | 91.4 | 730 | 0.24 | 52.8 | Unrecrystallized |
| 8 | D | 1250 | 1050 | 920 | 580 | 91.4 | 740 | 0.24 | 52.7 | 7.9 |
| 9 | D | 1250 | 1050 | 920 | 580 | 91.4 | 750 | 0.24 | 52.3 | 7.7 |
| 10 | D | 1250 | 1050 | 920 | 580 | 91.4 | 760 | 0.24 | 50.6 | 8.6 |
| 11 | F | 1250 | 1050 | 900 | 580 | 91.4 | 750 | 0.24 | 55.9 | 9.6 |
| 12 | F | 1250 | 1050 | 900 | 580 | 91.4 | 750 | 0.24 | 59.1 | Unrecrystallized |
| 13 | F | 1250 | 1050 | 930 | 580 | 91.4 | 750 | 0.24 | 67.1 | Unrecrystallized |
| 14 | F | 1250 | 1050 | 870 | 580 | 92.3 | 750 | 0.22 | 60.2 | Unrecrystallized |
| 15 | F | 1250 | 1050 | 870 | 580 | 91.4 | 750 | 0.24 | 51.8 | Unrecrystallized |
| 16 | F | 1250 | 1050 | 870 | 580 | 88.9 | 750 | 0.31 | 59.4 | Unrecrystallized |
| 17 | D | 1250 | 1050 | 900 | 640 | 91.4 | 750 | 0.24 | 54.7 | 9.2 |
| 18 | F | 1250 | 1050 | 900 | 640 | 91.4 | 750 | 0.24 | 55.0 | 9.6 |
| 19 | F | 1250 | 1050 | 900 | 640 | 91.4 | 750 | 0.24 | 50.2 | 14.0 |
| 20 | G | 1250 | 1050 | 900 | 580 | 92.3 | 750 | 0.22 | 63.4 | 8.2 |
| 21 | G | 1250 | 1050 | 900 | 580 | 91.4 | 750 | 0.24 | 65.8 | 6.3 |
| 22 | G | 1250 | 1050 | 900 | 580 | 88.9 | 750 | 0.31 | 61.6 | 7.6 |
| 23 | H | 1250 | 1050 | 900 | 550 | 91.4 | 740 | 0.24 | 56.0 | 6.9 |
| 24 | H | 1250 | 1050 | 930 | 550 | 91.4 | 740 | 0.24 | 57.0 | 7.2 |
| 25 | H | 1250 | 1050 | 870 | 550 | 91.4 | 740 | 0.24 | 55.3 | 7.0 |
| 26 | I | 1250 | 1050 | 900 | 550 | 91.4 | 740 | 0.24 | 57.2 | 8.6 |
| 27 | I | 1250 | 1050 | 870 | 550 | 91.4 | 740 | 0.24 | 58.2 | 8.6 |
| 28 | J | 1250 | 1050 | 910 | 550 | 91.4 | 760 | 0.24 | 51.5 | 10.7 |
| 29 | J | 1250 | 1050 | 872 | 550 | 91.4 | 760 | 0.24 | 51.2 | 10.9 |

| Experiment No. | Ratio of unrecrystallied area (%) | Amount of Nb-based precipitate (ppm by mass) | Average grain diameter of Nb-based precipitate (nm) | Compression strength after DI can making (kgf/cm2) | Steel sheet surface Rmax after DI can making (μm) | Working heat | Compression strength | Surface roughness | Remarks |
|---|---|---|---|---|---|---|---|---|---|
| 1 | 0 | 81 | 10 | 6.6 | 11.9 | ⊙ | X | X | Comparative Example |
| 2 | 0 | 78 | 12 | 6.4 | 12.8 | ⊙ | X | X | Comparative Example |

TABLE 2-continued

| | | | | | | | | | |
|---|---|---|---|---|---|---|---|---|---|
| 3 | 0 | 82 | 11 | 6.5 | 11.2 | ◎ | X | X | Comparative Example |
| 4 | 0 | 223 | 25 | 6.8 | 11.1 | ◎ | ○ | ○ | Example |
| 5 | 38 | — | — | — | — | — | — | — | Comparative Example |
| 6 | 0 | 139 | 15 | 7.0 | 8.2 | ◎ | ○ | ○ | Example |
| 7 | 10 | — | — | — | — | — | — | — | Comparative Example |
| 8 | 0 | 150 | 12 | 7.0 | 7.9 | ◎ | ○ | ○ | Example |
| 9 | 0 | 146 | 12 | 6.9 | 7.6 | ◎ | ○ | ○ | Example |
| 10 | 0 | 167 | 13 | 6.8 | 8.9 | ◎ | ○ | ○ | Example |
| 11 | 0 | 488 | 38 | 7.2 | 9.4 | ◎ | ○ | ○ | Example |
| 12 | 24 | — | — | — | — | — | — | — | Comparative Example |
| 13 | 47 | — | — | — | — | — | — | — | Comparative Example |
| 14 | 20 | — | — | — | — | — | — | — | Comparative Example |
| 15 | 7 | — | — | — | — | — | — | — | Comparative Example |
| 16 | 19 | — | — | — | — | — | — | — | Comparative Example |
| 17 | 0 | 173 | 20 | 7.0 | 9.0 | ◎ | ○ | ○ | Example |
| 18 | 0 | 490 | 45 | 7.0 | 9.5 | ◎ | ○ | ○ | Example |
| 19 | 0 | 660 | 70 | 6.7 | 15.4 | ◎ | ○ | X | Comparative Example |
| 20 | 0 | 675 | 63 | 7.5 | 8.5 | X | ◎ | ○ | Comparative Example |
| 21 | 0 | 654 | 57 | 7.7 | 5.6 | X | ◎ | ◎ | Comparative Example |
| 22 | 0 | 666 | 59 | 7.4 | 7.5 | X | ◎ | ○ | Comparative Example |
| 23 | 0 | 155 | 15 | 7.1 | 6.5 | ◎ | ○ | ◎ | Example |
| 24 | 0 | 146 | 13 | 7.1 | 6.9 | ○ | ○ | ◎ | Example |
| 25 | 0 | 163 | 13 | 7.0 | 6.6 | ○ | ○ | ◎ | Example |
| 26 | 0 | 483 | 40 | 7.1 | 9.1 | ○ | ○ | ○ | Example |
| 27 | 0 | 490 | 40 | 7.2 | 9.1 | ○ | ○ | ○ | Example |
| 28 | 0 | 670 | 60 | 6.8 | 11.0 | ◎ | ○ | X | Comparative Example |
| 29 | 0 | 685 | 60 | 6.7 | 11.1 | ◎ | X | X | Comparative Example |

Table 2 indicates that the examples of the present invention are excellent in compression strength after can making and in suppressing the working heat and surface roughness and have properties suitable for a base sheet of a laminated steel sheet used for dry ironing. On the other hand, the comparative examples are inferior in any one of these properties.

A steel sheet for cans having excellent surface properties according to exemplary embodiments of the present invention causes little surface roughness and no exfoliation of a film even after drawing and ironing. Therefore, it is possible to provide a laminated steel sheet for cans which is provided with excellent surface properties after working. In addition, a production method according to the present invention is capable of producing the steel sheet for cans with excellent surface properties using existing equipment and thus is industrially advantageous as compared with a general method which requires dedicated equipment and further improvement of operating technique.

The invention claimed is:

1. A steel sheet for cans with excellent surface properties after drawing and ironing, the steel sheet containing, by % by mass, 0.0063 to 0.01% of C, 0.05% or less of Si, 0.05 to 0.60% of Mn, 0.02% or less of P, 0.02% or less of S, 0.01 to 0.10% of Al, 0.0015 to 0.0050% of N, and 0.020 to 0.080% of Nb, the C and Nb contents satisfying expression (1) below, the balance being composed of Fe and inevitable impurities, wherein the amount of Nb-based precipitates is 20 to 500 ppm by mass, the average grain diameter of the Nb-based precipitates is 10 to 100 nm, and the average crystal grain diameter of ferrite is 6.9 to 9.9 μm:

$$0.4 \leq (Nb/C) \times (12/93) \leq 2.5 \quad (1)$$

wherein Nb and C each indicate a content (% by mass).

2. The steel sheet for cans with excellent surface properties after drawing and ironing according to claim 1, wherein the steel sheet for cans is a laminated steel sheet including a chromium metal plating film formed on a surface of a steel sheet, a chromium oxide layer formed on the plating film, and an organic resin coating layer formed on the chromium oxide layer.

3. A steel sheet for cans with excellent surface properties after drawing and ironing, the steel sheet consisting essentially of, by % by mass, 0.0063 to 0.01% of C, 0.05% or less of Si, 0.05 to 0.60% of Mn, 0.02 or less of P, 0.02% or less of S, 0.01 to 0.10% of Al, 0.0015 to 0.0050% of N, and 0.020 to 0.080% of Nb, the C and Nb contents satisfying expression (1) below, the balance being composed of Fe and inevitable impurities, wherein the amount of Nb-based precipitates is 20 to 500 ppm by mass, the average grain diameter of the Nb-based precipitates is 10 to 100 nm, and the average crystal grain diameter of ferrite is 6.9 to 9.9 μm:

$$0.4 \leq (Nb/C) \times (12/93) \leq 2.5 \quad (1)$$

wherein Nb and C each indicate a content (% by mass).

4. The steel sheet for cans with excellent surface properties after drawing and ironing according to claim 3, wherein the steel sheet for cans is a laminated steel sheet including a chromium metal plating film formed on a surface of a steel sheet, a chromium oxide layer formed on the plating film, and an organic resin coating layer formed on the chromium oxide layer.

* * * * *